United States Patent [19]

Rez

[11] 4,426,002

[45] Jan. 17, 1984

[54] HANDLED MOLD PACKAGE

[76] Inventor: Donald H. Rez, 301 - 36th St., Newport Beach, Calif. 92663

[21] Appl. No.: 407,890

[22] Filed: Aug. 13, 1982

[51] Int. Cl.[3] ..... B65D 83/04; B65D 1/36; C10L 11/02; B28B 7/06

[52] U.S. Cl. ..... 206/523; 206/532; 206/538; 206/558; 206/564; 44/40; 249/127; 249/128

[58] Field of Search ..... 206/523, 485, 524, 583, 206/558, 447, 564, 461, 462, 472, 528, 531, 532, 534.1, 534.2, 538; D23/106; 431/125; 272/8 F; 249/55, 84, 117, 118, 119, 123, 128, 134, 137, 143, 160, 164; 44/38, 40, 14

[56] References Cited

U.S. PATENT DOCUMENTS

| | | | |
|---|---|---|---|
| 304,976 | 9/1884 | Traylor | 249/134 |
| 2,858,224 | 10/1958 | Darrah | 206/820 |
| 2,933,378 | 4/1960 | Mustin et al. | 44/38 |
| 3,028,228 | 4/1962 | Chaplin | 44/14 |
| 3,166,227 | 1/1965 | Ragnow | 206/523 |
| 3,223,232 | 12/1965 | Coen | 206/523 |
| 3,377,229 | 4/1968 | Bryan | 431/125 |
| 3,389,195 | 6/1968 | Gianakos et al. | 206/523 |
| 3,415,364 | 12/1968 | Schneider | 206/524 |
| 3,416,648 | 12/1968 | Levi | 206/523 |
| 3,684,235 | 8/1972 | Schopbach | 249/127 |
| 4,290,408 | 9/1981 | Juett | 126/25 R |
| 4,305,502 | 12/1981 | Gregory et al. | 206/532 |

FOREIGN PATENT DOCUMENTS

| | | | |
|---|---|---|---|
| 630480 | 12/1961 | Italy | 249/55 |

*Primary Examiner*—William T. Dixson, Jr.
*Assistant Examiner*—Bryon Gehman
*Attorney, Agent, or Firm*—William W. Haefliger

[57] ABSTRACT

A shippable assembly comprises:

(a) a first mold having a recess therein, and cast and hardened material in said recess, and (b) a protective package on the mold.

The package may comprise a second mold having a recess therein, and cast and hardened material in that recess.

6 Claims, 11 Drawing Figures

HANDLED MOLD PACKAGE

BACKGROUND OF THE INVENTION

This invention relates generally to packaging of cast bodies formed of various solids and a comentitious compound, and more particularly concerns packaging such bodies in the molds in which they are cast. In particular it concerns casting and packaging refractory products which by their nature are brittle and often have intricate shape.

There is a need for simplifying the packaging of heavy refractory or other products, as for example refractory logs used in fireplaces. Such logs or other bodies are difficult to handle, as for example in sets as sold, and can be damaged in shipment unless properly packaged; however, packaging is expensive as respects both labor and material.

SUMMARY OF THE INVENTION

Basically and fundamentally, the invention concerns the provision and use of a containing structure or structures preformed and/or assembled to act as a mold vessel or vessels for retaining a flowable or plastic material during curing thereof to a solid state body or bodies, followed by use of the vessel or vessels as shipping containers for such bodies, in situ. As a result, savings in material and labor are realized through the elimination of stripping and removing of bodies from the mold vessels and repackaging them for shipment.

One aspect of the invention concerns a method or process of forming a refractory body such as a refractory log, and typically multiple bodies, so that they can be shipped in molds in which they are cast. The process typically includes:

(a) providing a synthetic resinous mold having a downward recess sunk or formed therein, the recess wall having the irregular shape of one side of the body;

(b) introducing into the recess a slurry of refractory material to cover that wall; and (c) allowing the slurry to set to form the hardened body at least partially locked in the mold, whereby the mold and body may be packaged as a unit and shipped.

As will be seen, the exposed surface of the body may be covered prior to shipment, and in one form of the invention a second body and its mold may provide such cover, the two bodies then being surrounded by mold structure prior to mold interconnection and packaging. Also inserts may be provided to project into the slurry in the mold, for purposes as will appear.

It is another objective of the invention to employ the above described techniques in molding multiple castable bodies, for shipment, such bodies for example having intricate surface designs.

These and other objects and advantages of the invention, as well as the details of an illustrative embodiment, will be more fully understood from the following description and drawings in which:

DRAWING DESCRIPTION

DETAILED DESCRIPTION

Figure 1:
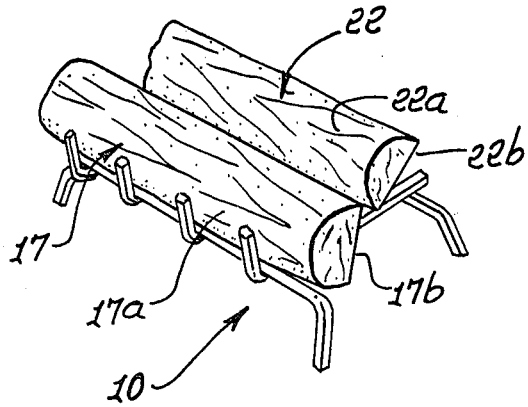
FIG. 1 is a perspective view of a fireplace grate, and refractory logs therein.

Referring first to FIG. 1, a fireplace system includes a metallic grate 10 and refractory logs 17 and 22. The latter may consist of cementitious or other refractory material. It will be noted that the logs have outer or frontward facing, curved sides 17*a* and 22*a* with irregular, bark-like surfaces, and flat, rearward facing sides, 17*b* and 22*b*.

Figure 2:
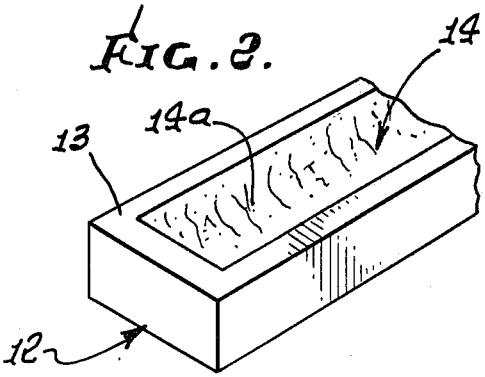
FIG. 2 is a perspective view of a mold for a refractory log body.
Figure 3:
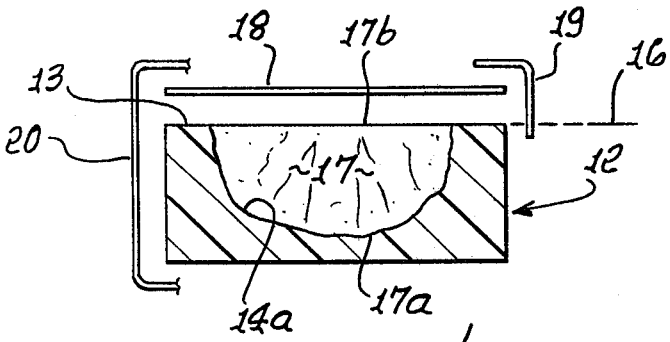
FIG. 3 is a vertical section taken through the FIG. 2 mold after the log body slurry has been poured in a mold recess.

In accordance with the invention, the process of forming such logs (or other castable bodies) includes providing a synthetic resinous (or for example styrofoam) mold 12 as in FIGS. 2 and 3. That mold is in the form of a block having an upward facing side 13, and a recess 14 sunk downwardly therein. The recess is longitudinally elongated, and has a bottom wall 14*a* or surface which is laterally curved, upwardly concave, and irregularly shaped in the "negative" form of tree bark. An aqueous slurry of refractory material is introduced into the recess 14 to level 16, covering wall 14*a*, and cures in situ to form solid log body 17. The latter may be considered at least partially locked in the mold, due to close interfit with the irregularities at surface 14*a*.

The mold and log body may be packaged as a unit and shipped to a user. To this end, a protective sheet 18, as for example cardboard, may be applied over the substantially co-planar flat side 17*b* of the log body and mold upper side 13, secured in place as by an adhesive or other retainer 19, and placed in a protective package 20 for shipment. The user need only remove the package and cover, and strip off the mold, to access the log body for use on the grate 10.

Figure 5:
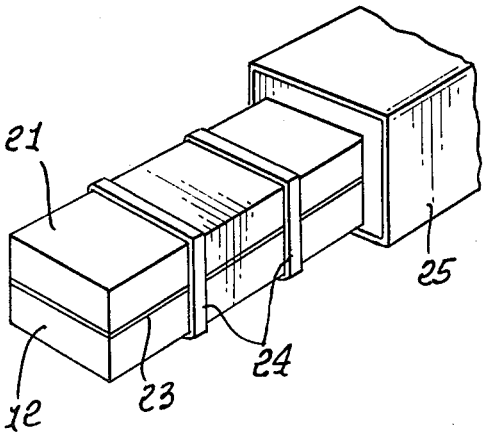
FIG. 5 is a perspective view of the molds of FIG. 4, after being tied together, for packaging.
Figure 4:
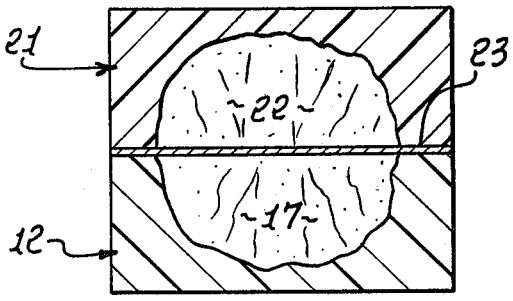
FIG. 4 is a view like FIG. 3, but showing two molds and two log bodies, in mutually covering relation and positioned for packaging.

A second mold 21 and log body 22 therein may be provided and formed in the same manner as described above, and one of the two log bodies (for example body 22) and its associated mold may be brought into protective or covering relation with the other log body in its mold. See FIG. 4 in this regard, wherein a protective sheet 23 is also inserted between the two molds and log bodies. Note that the two log bodies 17 and 22 are completely protected by the light weight plastic molds 12 and 21. FIG. 5 shows the FIG. 4 assembly retained by straps, such as steel bands 24 wrapped and tightened about the molds. The resultant unit is then introduced into shipping package 25 for shipment.

Figure 6:
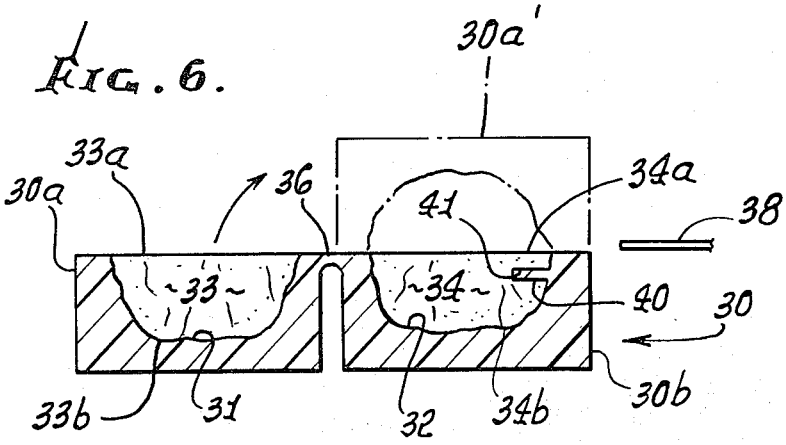
FIG. 6 is a view like FIG. 3, but showing a hinged mold, with two log body recesses.

FIG. 6 shows a single mold 30, like mold 12, provided with two parallel elongated recesses 31 and 32 like recess 14, for casting and forming of log bodies 33 and 34 having flat upper sides 33*a* and 34*a*. Irregular, bark-like, curved outer sides of the cast and set log bodies appear at 33*b* and 34*b*. Refractory slurry introduced into both recesses forms the log bodies.

Mold 30 has an elongated hinge region 36 half way between the recesses 31 and 32, and which accommodates swinging displacement of one of the mold sections 30*a* and 30*b*, with its log body therein, into inverted position (indicated for example by broken lines 30*a*') protectively covering the other log body in its mold section. A protective sheet 38 may be applied between the log bodies and their mold sections, in the same manner as in FIG. 4. Also, the molds may be connected together and packaged, as in FIG. 5.

Figure 7:
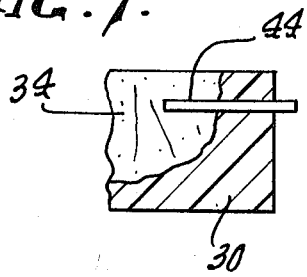
FIG. 7 is a fragmentary section showing an insert in the mold and log body.

FIG. 6 also shows the provision of an insert in the mold to extend into the recess for at least partial encapsulation by the slurry and log body. See for example insert 40, integral with the mold, to be removable from the log body upon removal of the mold from that body. Thus, for example, a hole or holes 41 may be provided in the log body to receive a reinforcement bar projection. Alternatively, and as seen in FIG. 7, the insert 44 is rigid and remains attached to the log body upon removal of the mold. Note that insert 44 projects from the mold 30 into the log body and may consist of a steel rod.

Figure 8:
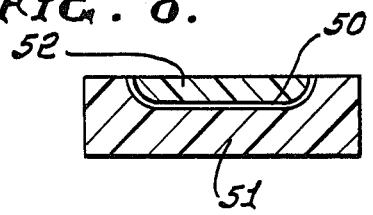
FIG. 8 is a view like FIG. 3, but showing another article in the mold recess.

In FIG. 8, the castable body 50 takes another form, in mold 51 (corresponding to mold 12). For example, it may comprise a shallow vessel, or other object. Note removable mold top 52 overlying the vessel.

Figure 9:
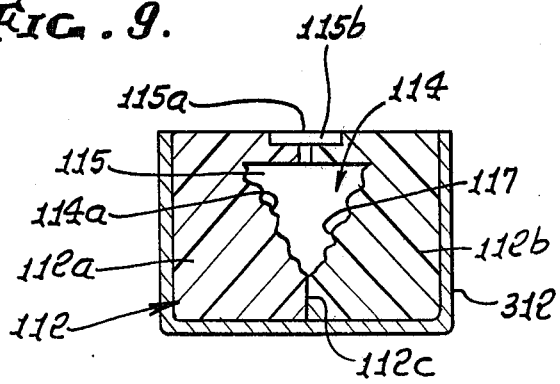
FIG. 9 is a view like FIG. 3, showing a modification.

In FIG. 9, the mold 112 is like mold 12 of FIG. 3; however, it is formed in sections 112*a* and 112*b*, with a parting line 112*c* therebetween. Outer packaging 312 holds the mold sections together, to receive the casting slurry in cavity or recess 114. The recess walls 114*a* have intricate shape, and the use of mold sections permits removal or stripping of the mold from the cast body, by the purchase, after shipment in situ in the mold.

Figure 10:
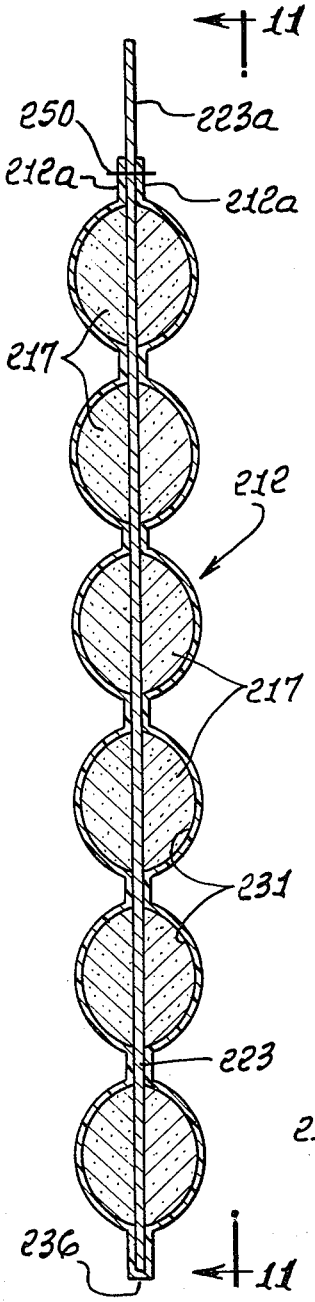
FIG. 10 is a vertical section showing a modification.
Figure 11:
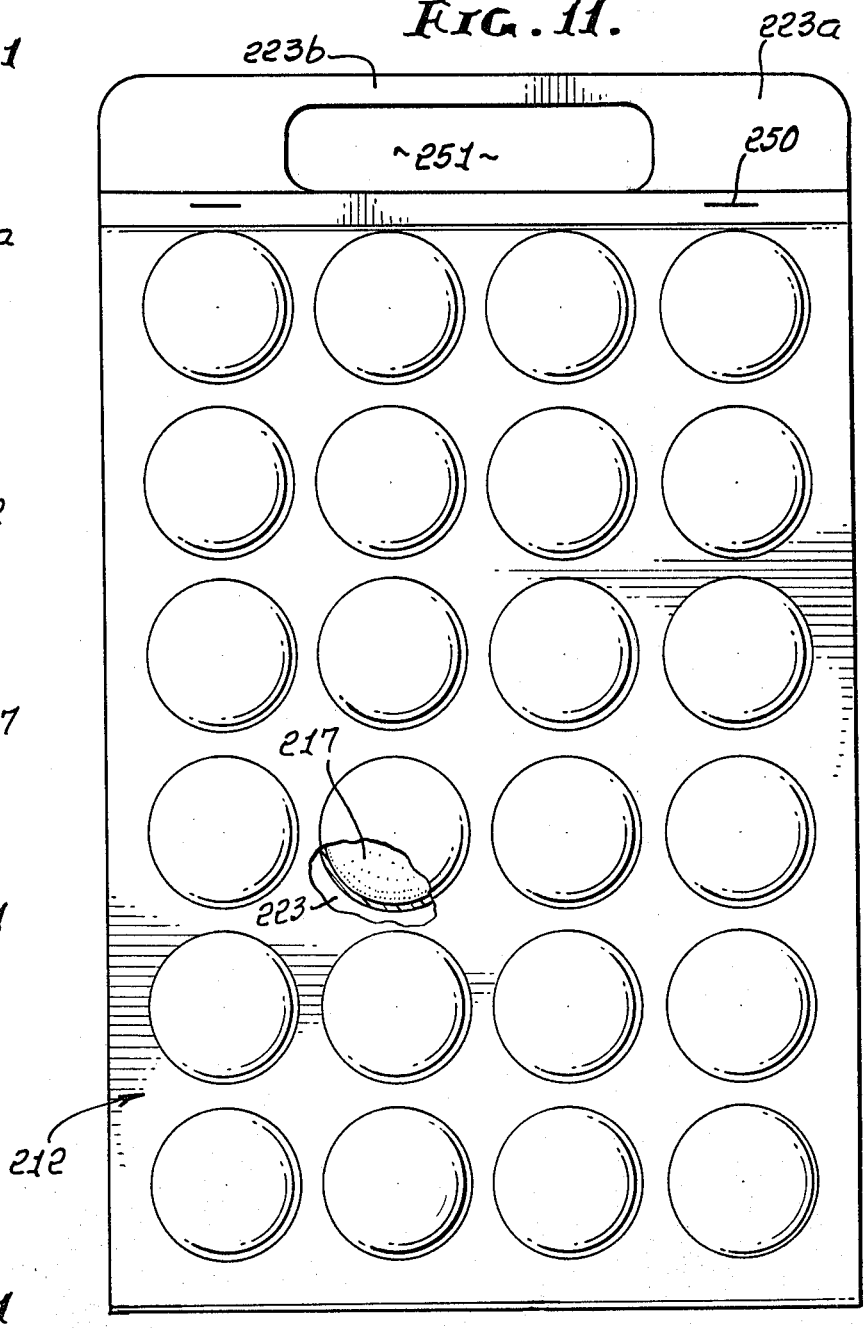
FIG. 11 is a side elevation taken on lines 11—11 of FIG. 10.

In FIGS. 10 and 11, the cast refractory bodies 217 are to be used as charcoal-like radiants in a barbecue or cooker. Casting is done in a mold vessel 212, a thin acrylic or styrene shell, which has been suitably thermo-formed over a pattern whose surface closely resembles the surfaces of the bodies 217. The lightweight shell is hinged at 236 to permit folding of two halves, with bodies 217 contained in recesses 231. A cardboard of other proective sheet 223 is introduced between the shell halves, and the latter have edge flanges 212*a* which may be connected (as by stapling at 250) to the sheet 223. The sheet projects at 223*a* and has a hand opening at 251, providing a handle 223*b* by which the assembly may be easily carried, shipped, merchandised, displayed, etc.

As an example, 48 (or other number) semi-spherical radiant bodies 217 may be formed in the foldable shell 212, the bodies measuring about one inch high (radius) and two inches in diameter. The refractory cementitious bodies are characterized by a minimum of absorption (due to very smooth and continuous surfaces formed against the shell), and their surfaces are easily cleaned. Their shapes should allow 10% to 20% void space between bodies when piled in a barbecue or cooker receptacle, as on a grate, to be gas flame heated. Such bodies improve over currently used porous products of volcanic origin which are difficult to clean, and absorb grease drippings.

From the above it is seen that a saving in labor and materials exists by virtue of the fact that once the casting is made in the mold, the subsequent practice of stripping or removing the cast body from the mold prior to shipment is eliminated, along with re-packaging of the case body for shipment. Also, by simple visual inspection of the mold cavity during mold assembly or prior to pouring into an open mold, it becomes possible to assure proper surface finish and configuration of the final product. Weighing or fluoroscopic inspection of the body in the mold will indicate whether or not the cast slurry has been fully charged into the mold. The molds, mold vessels or containers may consist of the following materials, although other materials are usable: styrene foam or sheets, paper or paper mache, and synthetic or natural fiber treated to resist passage of fluids before hardening has taken place.

Examples of cast products include (but are not limited to) picture frames, furniture, decorative escutcheon, lamp bases, paper weights, book ends, theme "carvings" (i.e. Mayan calenders, etc,) busts of celebrities, sculptured articles, garden objects such as furniture and decorative animals and statues, refractories for fire places, radiants for barbecue, gas and oil heaters, filter elements, investment type castings with only a sprue to remove from the finished products, and closures and containers.

Examples of castable materials include polyester resin and catalyst filled or reinforced or extended; epoxide compounds, urethane products; Portland cement; plaster and gypsum products; and refractory cements.

Further, the inside (exposed) surfaces of the mold cavity may be coated with a material which will transfer to the manufacture (cast) product. Examples are color coatings (as for example to transfer a logo or design onto the cast body); and polyvinyl acetate compounds which will adhere to the cast refractory, but not to a styrofoam mold. See for example transferrable coating 117 in FIG. 9. Exothermic reactions may be promoted by the molding material, for example to enhance the curing of the cast material in the mold, and/or said coating transfer, aided by insulative properties of styrene foam.

If radical undercuts in the cast body are required, the use of a friable mold permits ease of stripping of the mold from the body. As described, the use of a hinge integral with the mold facilitates packaging.

In FIG. 9, the surface 115*a* associated with a poured slurry body 115 remains free. It may be integral with body 115, or may be defined by an insert or plug 115*b* placed in the mold after pouring of body 115. Also, surface 115*a* may be hand finished, in view of its exposure.

I claim:

1. A shippable assembly comprising (a) a first mold having a recess therein, and cast and hardened material in said recess, and (b) a protective package on the mold, said package comprising a second mold having a recess therein, and cast and hardened material in said second mold recess, (c) said molds surrounding said material in said recesses, and being interconnected and retained in mutually protective adjacency, (d) the package including a protective sheet confined between the two molds and separating the material in said recesses, said sheet connected to at least one of the molds and projecting from the molds to support same including said material when the sheet is oriented vertically.

2. The assembly of claim 1 wherein the mold or molds consists of styrofoam.

3. The assembly of claim 1 wherein each of said molds provide multiple recesses for said material.

4. The assembly of claim 1 wherein said material consists of refractory material to form radiants for barbecues or the like.

5. The assembly of claim 1 wherein the two molds are hingedly interconnected and folded together.

6. The assembly of claim 1 including a transferrable coating on the recess wall to be transferred to the slurry introduced into the recess.

* * * * *